US011732866B2

(12) United States Patent
Song

(10) Patent No.: US 11,732,866 B2
(45) Date of Patent: Aug. 22, 2023

(54) LAMP FOR VEHICLE AND VEHICLE INCLUDING THE SAME

(71) Applicant: HYUNDAI MOBIS CO., LTD., Seoul (KR)

(72) Inventor: Ki Ryong Song, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/718,471

(22) Filed: Apr. 12, 2022

(65) Prior Publication Data

US 2022/0357012 A1 Nov. 10, 2022

(30) Foreign Application Priority Data

May 6, 2021 (KR) ..... 10-2021-0058699

(51) Int. Cl.

| | |
|---|---|
| ***F21S 45/47*** | (2018.01) |
| ***F21S 43/237*** | (2018.01) |
| ***F21V 17/12*** | (2006.01) |
| ***F21S 43/27*** | (2018.01) |
| ***F21S 45/49*** | (2018.01) |

(52) U.S. Cl.

CPC ..... *F21S 45/47* (2018.01); *F21S 43/237* (2018.01); *F21S 43/27* (2018.01); *F21S 45/49* (2018.01); *F21V 17/12* (2013.01)

(58) Field of Classification Search

CPC ..... F21S 43/237; F21S 43/37; F21S 45/47; F21S 45/49

See application file for complete search history.

(56) References Cited

U.S. PATENT DOCUMENTS

| | | | | |
|---|---|---|---|---|
| 3,761,706 | A * | 9/1973 | Frey | G02B 6/0005 362/490 |
| 5,452,390 | A * | 9/1995 | Bechtel | G02B 6/4292 385/60 |
| 9,563,001 | B2 * | 2/2017 | Masuda | G02B 6/0006 |
| 10,874,874 | B2 * | 12/2020 | Samaha | A61N 5/0603 |
| 2003/0147254 | A1 * | 8/2003 | Yoneda | G02B 6/4298 362/555 |

* cited by examiner

*Primary Examiner* — Matthew J. Peerce
(74) *Attorney, Agent, or Firm* — NovoTechIP International PLLC

(57) ABSTRACT

Disclosed is a lamp for a vehicle, the lamp including a light source unit including a light source and a board, an optical fiber disposed forward of the light source unit, an inner lens disposed between the light source unit and the optical fiber, provided to be in close contact with the board, and configured to fix or hold one side of the optical fiber, a heat sink disposed rearward of the light source unit and provided to be in close contact with the board, an elastic member disposed rearward of the heat sink, provided to be in close contact with the heat sink, and having elasticity, and an aiming bolt disposed rearward of the elastic member and configured to penetrate the elastic member and press a rear surface of the heat sink, in which the aiming bolt is movable in a forward/rearward direction.

16 Claims, 4 Drawing Sheets

LAMP FOR VEHICLE AND VEHICLE INCLUDING THE SAME

CROSS-REFERENCE TO RELATED APPLICATIONS

This application claims priority to and the benefit of Korean Patent Application No. 10-2021-0058699 filed in the Korean Intellectual Property Office on May 6, 2021, the entire disclosure of which is incorporated herein by reference.

BACKGROUND

1. Technical Field

The present disclosure relates to a lamp for a vehicle and a vehicle including the same, and more particularly, to a lamp for a vehicle that includes an optical fiber, and a vehicle including the same.

2. Discussion of Related Art

Lamps for a vehicle, which have optical fibers, may be classified into lamps in which light is emitted to the outside from an end of an optical fiber, and lamps in which light is emitted to the outside from a lateral portion of an optical fiber. In the case of the lamp in which light is emitted from the end of the optical fiber, only the end of the optical fiber needs to be exposed to the outside. However, in the case of the lamp in which light is emitted from the lateral portion of the optical fiber, most of the region of the optical fiber needs to be exposed to the outside.

However, in the related art, most of the region of the optical fiber is exposed to the outside without being fixed to another component in the case of the lamp for a vehicle in which light is emitted to the outside from the lateral portion of the optical fiber. For this reason, there occurs a problem in that the optical fiber sags or deviates from its original position due to a decrease in tension of the optical fiber while the lamp is used.

SUMMARY

The present disclosure has been made in an effort to provide a lamp for a vehicle, which has an optical fiber and a structure capable of adjusting tension of the optical fiber, thereby preventing the optical fiber from sagging or deviating from an original position.

An exemplary embodiment of the present disclosure provides a lamp for a vehicle, the lamp including: a light source unit including a light source and a board; an optical fiber disposed forward of the light source unit; an inner lens disposed between the light source unit and the optical fiber, provided to be in close contact with the board, and configured to fix one side of the optical fiber; a heat sink disposed rearward of the light source unit and provided to be in close contact with the board; an elastic member disposed rearward of the heat sink, provided to be in close contact with the heat sink, and having elasticity; and an aiming bolt disposed rearward of the elastic member and configured to penetrate the elastic member and press a rear surface of the heat sink, in which the aiming bolt is movable in a forward/rearward direction.

The aiming bolt may include: a body region configured to penetrate the elastic member and press the rear surface of the heat sink; and a head region disposed at a rear side of the elastic member and having a vertical cross-sectional area larger than a vertical cross-sectional area of the body region, and the vertical cross-sectional area of the head region may be larger than an area of a through-hole formed in the elastic member and penetrated by the body region.

The body region may have a length that enables the head region to press the elastic member when the aiming bolt rotates and moves forward by a predetermined distance relative to the elastic member.

The body region and the heat sink may be coupled by a bolt-nut engagement.

The elastic member may be a flat spring, and the flat spring may include: a close-contact region which is a region being in close contact with the heat sink; and a spacing region extending from the close-contact region and spaced apart rearward from the heat sink.

The aiming bolt may penetrate the spacing region.

The close-contact region may have a flat plate shape, and the spacing region may have a plate shape having a curved surface convex rearward.

The elastic member may include: a plate member having a flat plate shape and provided to be in close contact with the heat sink; and a spring member having a front end provided to be in close contact with the plate member and a rear end provided to be in close contact with the head region, and the body region may be inserted into the spring member.

The plate member may be made of a rubber material.

The lamp may further include a housing having an inner space formed in the forward/rearward direction, and the heat sink and the elastic member may be accommodated in the inner space, and the heat sink and the elastic member may be fixed to an inner surface of the housing that surrounds the inner space.

The lamp may further include an optical fiber bracket unit disposed forward of the inner lens, penetrated by the optical fiber, and configured to fix the optical fiber, and the optical fiber bracket unit may include: a lower bracket disposed below the optical fiber, penetrated by the optical fiber, and fixedly coupled to the board; and an upper bracket disposed above the optical fiber, penetrated by the optical fiber, and fixedly coupled to the lower bracket.

The lamp may further include a lens bracket disposed forward of the inner lens, fixedly coupled to the board, and configured to press the inner lens toward the board.

A horizontal cross-section of the spacing region may have an arc shape.

A center of the arc shape may be positioned in the light source of the light source unit.

Another exemplary embodiment of the present disclosure provides a vehicle including: a lamp for a vehicle, in which the lamp includes: a light source unit including a light source and a board; an optical fiber disposed forward of the light source unit; an inner lens disposed between the light source unit and the optical fiber, provided to be in close contact with the board, and configured to fix one side of the optical fiber; a heat sink disposed rearward of the board and provided to be in close contact with the board; an elastic member disposed rearward of the heat sink, provided to be in close contact with the heat sink, and having elasticity; and an aiming bolt disposed rearward of the elastic member and configured to penetrate the elastic member and press a rear surface of the heat sink.

The lamp may be a rear lamp.

According to the present disclosure, the lamp for a vehicle has the optical fiber and the structure capable of adjusting the tension of the optical fiber, thereby preventing the optical fiber from sagging or deviating from the original position.

DETAILED DESCRIPTION

Hereinafter, a lamp for a vehicle and a vehicle according to the present disclosure will be described with reference to the drawings.

Lamp for Vehicle

Figure 1:
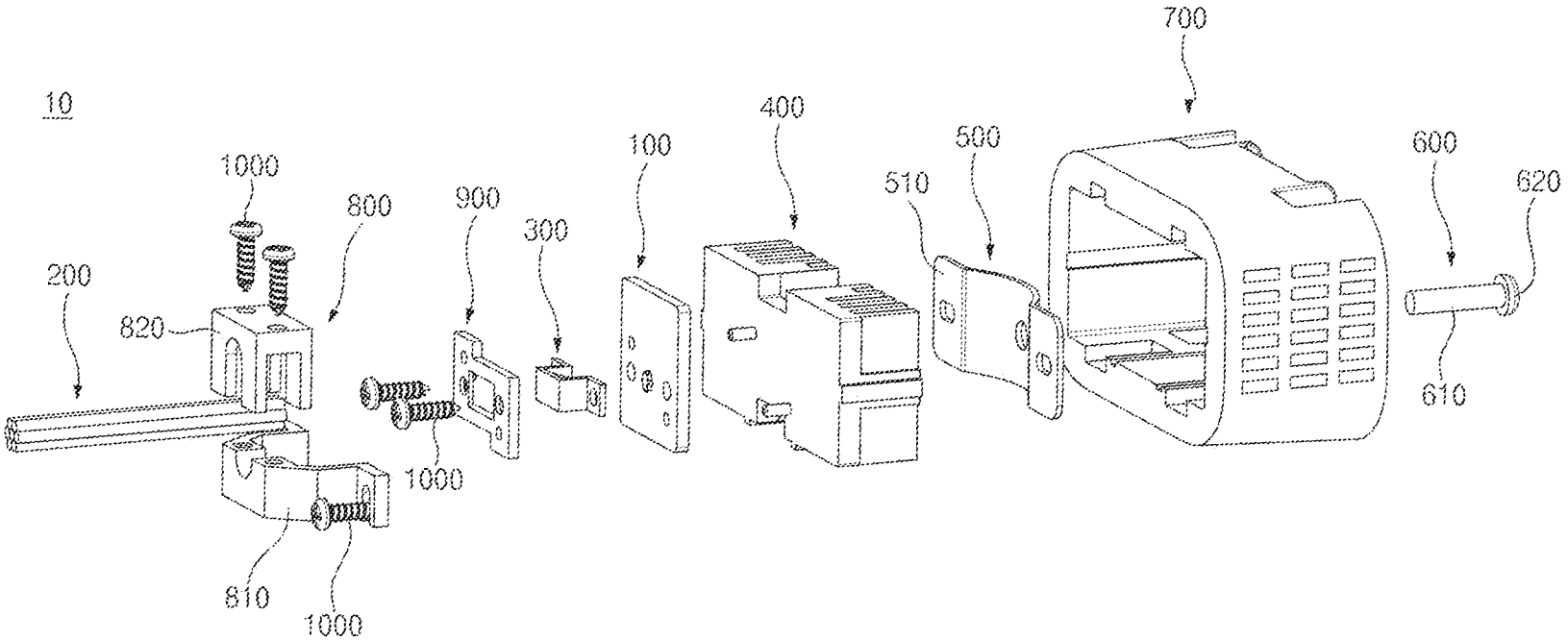
FIG. 1 is an exploded perspective view illustrating a disassembled state of a structure of a lamp for a vehicle according to an embodiment of the present disclosure.
Figure 2:
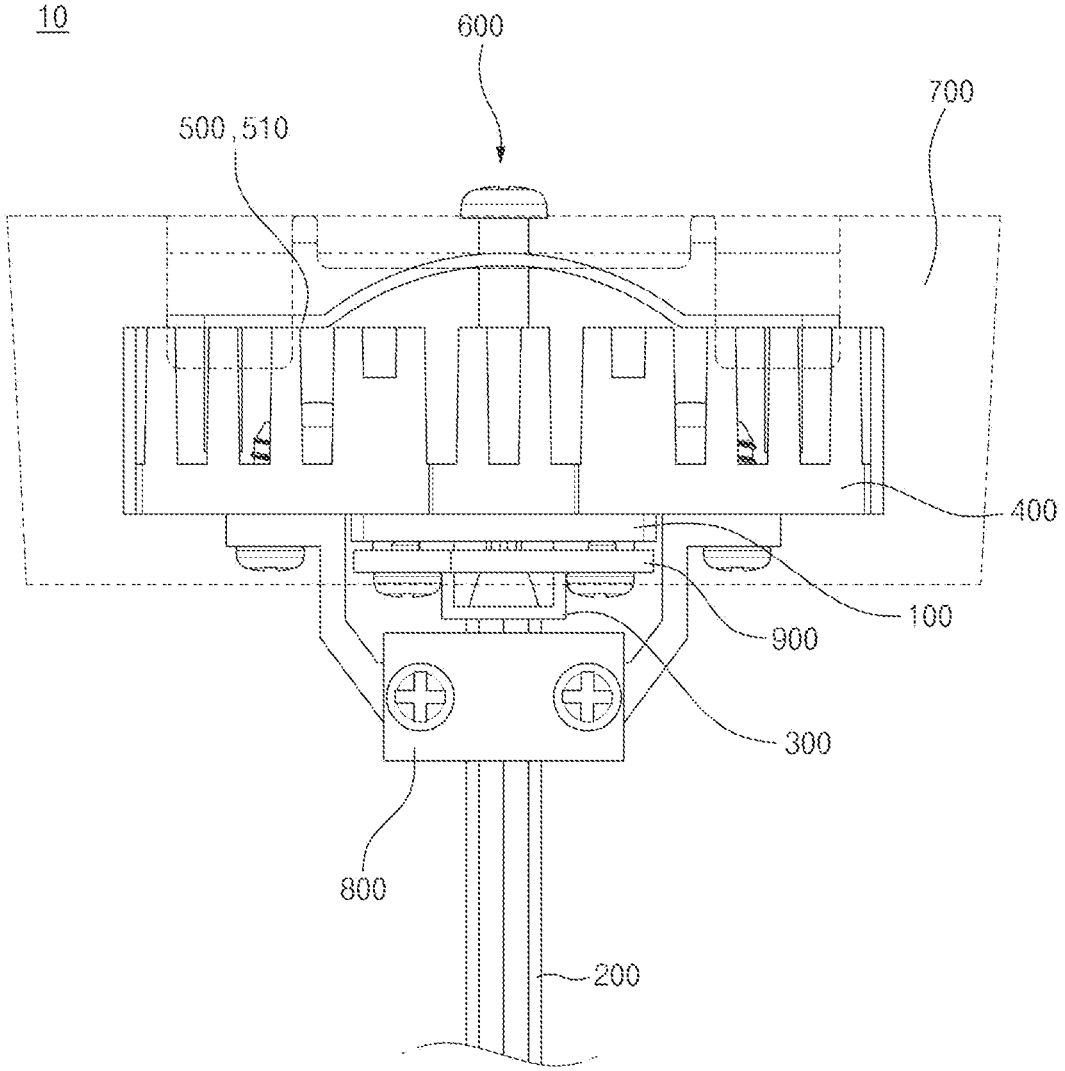
FIG. 2 is a horizontal cross-sectional view illustrating the structure of the lamp for a vehicle according to the embodiment of the present disclosure.
Figure 3:
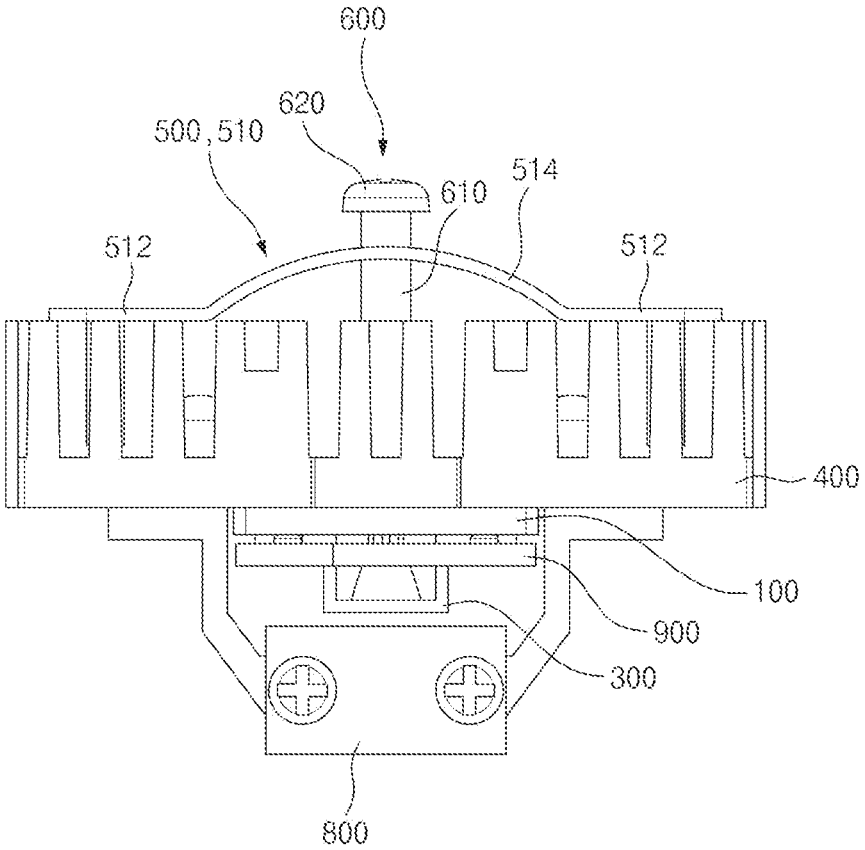
FIG. 3 is a horizontal cross-sectional view illustrating the structure of the lamp for a vehicle according to the embodiment of the present disclosure from which an optical fiber and a housing are removed.

FIG. 1 is an exploded perspective view illustrating a disassembled state of a structure of a lamp for a vehicle according to an embodiment of the present disclosure, and FIG. 2 is a horizontal cross-sectional view illustrating the structure of the lamp for a vehicle according to the embodiment of the present disclosure. FIG. 3 is a horizontal cross-sectional view illustrating the structure of the lamp for a vehicle according to the embodiment of the present disclosure from which an optical fiber and a housing are removed.

Referring to FIGS. 1 to 3, a lamp 10 for a vehicle (hereinafter, referred to as a 'lamp') according to the present disclosure may include: a light source unit 100 including a light source and a board; and an optical fiber 200 disposed forward of the light source unit 100. For example, the light source may be an LED, and the board may be a PCB. Meanwhile, the description of the optical fiber 200 will be replaced with the contents disclosed in the related art. Light emitted from the light source of the light source unit 100 may enter the optical fiber 200 and propagate in the optical fiber 200 while being totally reflected. In this case, the light propagating in the optical fiber 200 may be emitted to the outside through a lateral surface of the optical fiber 200.

The lamp 10 according to the present disclosure may include an inner lens 300 disposed between the light source unit 100 and the optical fiber 200 and provided to be in close contact with the board, and the inner lens 300 may fix or hold one side of the optical fiber 200. In more detail, the inner lens 300 may fix or hold a rear end of the optical fiber 200.

Referring to FIGS. 1 to 3, the lamp 10 according to the present disclosure may further include a heat sink 400 disposed rearward of the light source unit 100, i.e., the board and provided to be in close contact with a rear surface of the board. The heat sink 400 may receive heat generated by the light source unit 100 and dissipate the heat to the outside, thereby cooling the light source unit 100. More particularly, the light source unit 100 and the heat sink 400 may be fixedly coupled to each other.

The lamp 10 according to the present disclosure may further include an elastic member 500 disposed rearward of the heat sink 400 and provided to be in close contact with the heat sink 400, and the elastic member 500 has elasticity. According to the present disclosure, when a shape of the elastic member 500 is deformed so that the amount of deformation is relatively large, the elastic member 500 may press forward the heat sink 400 disposed forward of the elastic member by using a restoring force of the elastic member 500. In this case, the heat sink 400 moves forward as described below, and thus the rear end of the optical fiber 100 (i.e., a region of the optical fiber facing the light source unit) also moves forward, such that the tension of the optical fiber 100 may decrease. In contrast, when a shape of the elastic member 500 is deformed so that the amount of deformation is relatively small, a degree to which the elastic member 500 presses the heat sink 400 forward also decreases, and thus the heat sink 400 moves rearward. Therefore, the rear end of the optical fiber 100 also moves rearward, such that the tension of the optical fiber 100 may increase. Therefore, according to the present disclosure, it is possible to adjust the tension of the optical fiber 100 by moving the heat sink 400 and the optical fiber 100 by adjusting the force applied to the elastic member 500.

Meanwhile, the lamp 10 according to the present disclosure may further include an aiming bolt 600 disposed rearward of the elastic member 500, and the aiming bolt 600 penetrates the elastic member 500 and presses a rear surface of the heat sink 400.

According to the present disclosure, the aiming bolt 600 may serve to adjust a magnitude of the force applied by the elastic member 500 to press the heat sink 400 by adjusting a magnitude of the force of pressing the elastic member 500. To this end, according to the present disclosure, the aiming bolt 600 may be movable in a forward/rearward direction. That is, according to the present disclosure, when the aiming bolt 600 moves forward, the deformation of the elastic member 500 increases, such that the force applied by the elastic member 500 to press the heat sink 400 forward may increase. When the aiming bolt 600 moves rearward, the deformation of the elastic member 500 decreases, such that the force applied by the elastic member 500 to press the heat sink 400 forward may decrease.

Referring to FIGS. 1 to 3, the aiming bolt 600 may include: a body region 610 configured to penetrate the elastic member 500 and press the rear surface of the heat sink 400; and a head region 620 disposed at a rear side of the elastic member 500 and having a vertical cross-sectional area larger than a vertical cross-sectional area of the body region 610.

The body region 610 may come into direct contact with the heat sink 400, and the head region 620 may directly press the rear surface of the elastic member 500. To this end, according to the present disclosure, the vertical cross-sectional area of the head region 620 may be larger than an area of a through-hole formed in the elastic member 500 and penetrated by the body region 610. Therefore, when the aiming bolt 600 moves forward by a predetermined distance or more, the head region 620 and the elastic member 500 interfere with each other, such that the aiming bolt 600 may press the elastic member 500 forward.

More particularly, the body region 610 may have a length that enables the head region 620 to press the elastic member 500 when the aiming bolt 600 rotates and moves forward by a predetermined distance relative to the elastic member 500. Meanwhile, the body region 610 and the heat sink 400 may be coupled by a bolt-nut engagement so that the aiming bolt 600 may move in the forward/rearward direction while rotating. That is, the body region 610 may serve as a bolt, and the heat sink 400 may serve as a nut.

Referring to FIGS. 1 to 3, the elastic member 500 of the lamp 10 according to the embodiment of the present disclosure may be a flat spring 510. The flat spring may be provided in the form of a plate manufactured to have a restoring force when the flat spring is deformed in shape.

In more detail, according to the embodiment of the present disclosure, the flat spring 510 may include close-contact regions 512 which are regions being in close contact with the heat sink 400, and a spacing region 514 extending from the close-contact regions 512 and spaced apart rearward from the heat sink 400. In more detail, the close-contact regions 512 may surround the spacing region 514. In addition, the close-contact region 512 may be fixedly coupled to the heat sink 400.

In this case, as illustrated in FIGS. 1 to 3, the aiming bolt 600, i.e., the body region 610 may penetrate the spacing region 514. Therefore, according to the embodiment of the present disclosure, when the aiming bolt 600 moves forward and presses the flat spring 510, the shapes of the close-contact regions 512 are not deformed, whereas the shape of the spacing region 514 may be deformed in a direction toward the heat sink 400.

For example, the close-contact region 512 may have a flat plate shape, and the spacing region 514 may have a plate shape having a curved surface convex rearward. More particularly, according to the embodiment of the present disclosure, a horizontal cross-section of the spacing region 514 may have an arc shape. A center of the arc shape may be positioned in the light source of the light source unit 100 in a state before the shape of the spacing region 514 is deformed by the aiming bolt 600.

Figure 4:
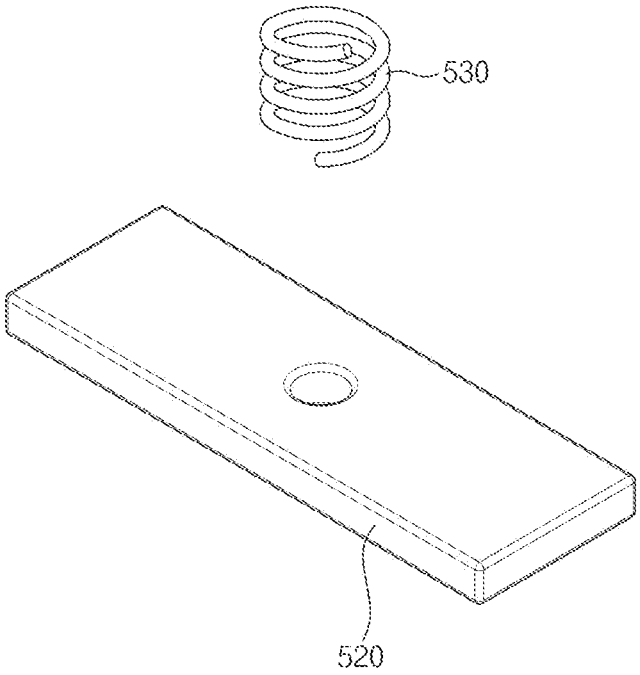
FIG. 4 is a view illustrating a configuration of an elastic member provided in a lamp for a vehicle according to another embodiment of the present disclosure.

FIG. 4 is a view illustrating a configuration of an elastic member provided in a lamp for a vehicle according to another embodiment of the present disclosure.

A structure of the lamp according to another embodiment of the present disclosure differs from the structure of the lamp according to the above-mentioned embodiment of the present disclosure in terms of the elastic member 500. The contents related to the lamp according to the embodiment of the present disclosure, except for the elastic member 500, may be equally applied to the lamp according to another embodiment of the present disclosure.

Referring to FIG. 4, the elastic member 500 provided in the lamp according to another embodiment of the present disclosure may include: a plate member 520 may have a flat plate shape and provided to be in close contact with the heat sink 400; and a spring member 530 having a front end provided to be in close contact with the plate member 520 and a rear end provided to be in close contact with the head region 620 (see FIGS. 1 to 3) of the aiming bolt. In this case, the body region 610 (see FIGS. 1 to 3) of the aiming bolt may be inserted into the spring member 530, and the body region of the aiming bolt may be in close contact with the plate member 520.

According to another embodiment of the present disclosure, when the aiming bolt moves forward, the spring member 530 having the rear end being in close contact with the head region 620 is compressed, and the compressed spring member 530 presses the plate member 520 forward. Therefore, the plate member 520 presses the heat sink 400 forward, and the heat sink 400 moves forward. In contrast, when the aiming bolt moves rearward, the spring member 530 is stretched, and thus the force applied by the spring member 530 to press the plate member 520 also decreases. Therefore, the heat sink 400 moves rearward.

Meanwhile, according to another embodiment of the present disclosure, the plate member 520 may be made of a rubber material. In this case, it is possible to minimize damage to the heat sink 400 caused by pressure applied by the plate member 520. For example, the plate member 520 may be made of a rubber material.

Meanwhile, referring back to FIGS. 1 to 3, the lamp 10 according to the present disclosure may further include a housing 700 having an inner space and an inner surface surrounding the inner space. The inner space may be formed in the forward/rearward direction, and the heat sink 400 and the elastic member 500 may be accommodated in the inner space.

The housing 700 may accommodate the heat sink 400 and the elastic member 500, thereby not only protecting the heat sink 400 and the elastic member 500 but also fixing or holding the heat sink 400 and the elastic member 500. In more detail, the heat sink 400 and the elastic member 500 may be fixed to an inner surface of the housing 700 that surrounds the inner space.

Meanwhile, the lamp 10 according to the present disclosure may further include an optical fiber bracket unit 800 disposed forward of the inner lens 300, penetrated by the optical fiber 200, and configured to fix or hold the optical fiber 200. The optical fiber bracket unit 800 may include: a lower bracket 810 disposed below the optical fiber 200, penetrated by the optical fiber 200, and fixedly coupled to the board of the light source unit 100; and an upper bracket 820 disposed above the optical fiber 200, penetrated by the optical fiber 200, and fixedly coupled to the lower bracket 810.

In addition, the lamp 10 according to the present disclosure may further include a lens bracket 900 disposed forward of the inner lens 300, fixedly coupled to the board, and configured to press the inner lens 300 rearward toward the board of the light source unit 100.

Meanwhile, according to the present disclosure, the lamp 10 according to the present disclosure may further include bolt members 1000 configured to couple the lower bracket 810 and the upper bracket 820 and couple the board of the light source unit 100, the inner lens 300, and the lens bracket 900.

Vehicle

A vehicle according to the present disclosure may include the lamp 10 for a vehicle.

The lamp 10 may include: the light source unit 100 including the light source and the board; the optical fiber 200 disposed forward of the light source unit 100; the inner lens 300 disposed between the light source unit 100 and the optical fiber 200, provided to be in close contact with the board, and configured to fix or hold one side of the optical fiber 200; the heat sink 400 disposed rearward of the board and provided to be in close contact with the board; the elastic member 500 disposed rearward of the heat sink 400, provided to be in close contact with the heat sink 400, and having elasticity; and the aiming bolt 600 disposed rearward of the elastic member 500 and configured to penetrate the elastic member 500 and press the rear surface of the heat sink 400. For example, the lamp provided in the vehicle according to the present disclosure may be a rear lamp.

Meanwhile, the above-described contents related to the lamp according to the present disclosure may be equally applied to the lamp provided in the vehicle according to the present disclosure.

The present disclosure has been described with reference to the limited embodiments and the drawings, but the present disclosure is not limited thereto. The present disclosure may be carried out in various forms by those skilled in the art, to which the present disclosure pertains, within the technical spirit of the present disclosure and the scope equivalent to the appended claims.

What is claimed is:

1. A lamp for a vehicle, the lamp comprising:

a light source unit comprising a light source and a board;

an optical fiber positioned in front of the light source unit;

an inner lens positioned between the light source unit and the optical fiber, in contact with the board, and connected to an end of the optical fiber;

a heat sink positioned at a rear of the light source unit and in contact with the board;

an elastic member positioned at a rear of the heat sink and in contact with the heat sink; and a bolt extending through the elastic member and configured to be movable in a first direction to press a rear surface of the heat sink, wherein the heat sink is configured to reduce a tension of the optical fiber when the rear of the heat sink is pressed by the bolt.

2. The lamp of claim 1, wherein:

the elastic member having a through-hole extending between rear and front sides of the elastic member, and the bolt comprises:

a body region extending through the through-hole of the elastic member and pressing the rear surface of the heat sink; and a head region positioned at the rear side of the elastic member and having a cross-sectional area larger than that of the body region, wherein the head region is larger than an opening of the through-hole.

3. The lamp of claim 2, wherein the body region has a length that allows the head region to press the elastic member when the bolt moves in the first direction.

4. The lamp of claim 2, wherein the body region and the heat sink are thread-coupled.

5. The lamp of claim 3, wherein the elastic member comprises a flat spring that includes:

a contact region in contact with the heat sink; and a spacing region extending from the contact region and spaced apart from the heat sink.

6. The lamp of claim 5, wherein the bolt extends through the spacing region.

7. The lamp of claim 5, wherein the contact region is flat, and the spacing region is curved.

8. The lamp of claim 5, wherein the elastic member comprises:

a flat plate member in contact with the heat sink; and a spring member having a front side in contact with the plate member and a rear side in contact with the head region of the bolt, and wherein the body region of the bolt extends through the spring member.

9. The lamp of claim 8, wherein the plate member comprises a rubber material.

10. The lamp of claim 1, further comprising a housing having an inner space and an inner surface surrounding the inner space, wherein the heat sink and the elastic member are positioned at the inner space, and the heat sink and the elastic member are coupled to the inner surface of the housing.

11. The lamp of claim 1, further comprising an optical fiber bracket unit positioned in front of the inner lens and configured to hold the optical fiber, the optical fiber bracket unit comprising:

a lower bracket positioned below the optical fiber and coupled to the board; heat sink; and an upper bracket positioned above the optical fiber and coupled to the lower bracket.

12. The lamp of claim 1, further comprising a lens bracket positioned in front of the inner lens, coupled to the board, and pressing the inner lens toward the board.

13. The lamp of claim 7, wherein the spacing region is acuate.

14. The lamp of claim 13, wherein a center of the spacing region is positioned to correspond to the light source of the light source unit.

15. A vehicle comprising the lamp of claim 1.

16. The vehicle of claim 15, wherein the lamp comprises a rear lamp of the vehicle.

* * * * *